US010604979B2

(12) United States Patent
Bacchetti

(10) Patent No.: US 10,604,979 B2
(45) Date of Patent: Mar. 31, 2020

(54) SYSTEM FOR THE ROTATABLE COUPLING OF A CLOSING ELEMENT AND STATIONARY SUPPORT STRUCTURE

(71) Applicant: IN & TEC S.R.L., Brescia (BS) (IT)

(72) Inventor: Luciano Bacchetti, Nave (IT)

( * ) Notice: Subject to any disclaimer, the term of this patent is extended or adjusted under 35 U.S.C. 154(b) by 0 days.

(21) Appl. No.: 16/300,553

(22) PCT Filed: May 18, 2017

(86) PCT No.: PCT/IB2017/052922
§ 371 (c)(1),
(2) Date: Nov. 10, 2018

(87) PCT Pub. No.: WO2017/199188
PCT Pub. Date: Nov. 23, 2017

(65) Prior Publication Data

US 2019/0390493 A1 Dec. 26, 2019

(30) Foreign Application Priority Data

May 18, 2016 (IT) ..... 102016000051288

(51) Int. Cl.
*E05D 5/02* (2006.01)
*E05D 7/04* (2006.01)
*E05D 7/081* (2006.01)

(52) U.S. Cl.
CPC ..... *E05D 7/0415* (2013.01); *E05D 5/0246* (2013.01); *E05D 7/081* (2013.01); *E05D 2007/0484* (2013.01); *E05Y 2900/132* (2013.01)

(58) Field of Classification Search
CPC ..... E05D 7/04; E05D 7/0415; E05D 7/081; E05D 5/0246; E05D 2007/0484; E05Y 2900/132; Y10T 16/534; Y10T 16/552
See application file for complete search history.

(56) References Cited

U.S. PATENT DOCUMENTS 1,169,283 A * 1/1916 Peterick ..... E05D 7/0423 16/241
2,316,528 A * 4/1943 Miles ..... E06B 3/02 49/388
2,530,331 A * 11/1950 Hubbs ..... E05D 7/081 16/245

(Continued)

FOREIGN PATENT DOCUMENTS

EP 2617925 7/2013
WO 2015060519 4/2015

*Primary Examiner* — Chuck Y Mah
(74) *Attorney, Agent, or Firm* — Themis Law

(57) ABSTRACT

A rotating coupling system for a closing element, such as a door, window, door or the like, and a stationary support structure, such as a wall, floor, frame or the like includes a hinge device anchorable to the closing element and a mounting plate anchorable to the stationary support structure. The hinge device has a hinge body and a pivot defining a first axis, and are coupled each other to rotate one with respect to the other around the axis. In particular, the pivot includes a coupling portion, which protrudes from the hinge body, and the mounting plate includes a plate-shaped body having a seat that receives the coupling portion of the pivot. The plate-shaped body further includes an adjusting member to adjust its position with respect to the stationary support structure.

8 Claims, 3 Drawing Sheets

(56) References Cited

U.S. PATENT DOCUMENTS

| | | | | | |
|---|---|---|---|---|---|
| 2,781,542 | A * | 2/1957 | West | E05D 7/081 | 16/236 |
| 3,115,665 | A * | 12/1963 | Cecala | E05D 7/081 | 16/241 |
| 3,148,407 | A * | 9/1964 | Glasbrenner | E05D 7/081 | 16/236 |
| 3,299,576 | A * | 1/1967 | Bobrowski | E05F 15/614 | 49/501 |
| 3,555,733 | A * | 1/1971 | Horgan, Jr. | E05D 5/0246 | 49/388 |
| 3,828,394 | A * | 8/1974 | Horgan, Jr. | E05D 5/0246 | 16/241 |
| 4,142,272 | A * | 3/1979 | Oogami | E05D 7/0423 | 16/245 |
| 4,209,946 | A * | 7/1980 | Akai | E05D 7/0423 | 16/245 |
| 4,646,472 | A * | 3/1987 | Sugawara | E05F 1/123 | 16/238 |
| 4,977,642 | A * | 12/1990 | Marinoni | E05D 5/0246 | 16/257 |
| 5,203,115 | A * | 4/1993 | Marinoni | E05D 5/0246 | 16/236 |
| 8,528,169 | B1 * | 9/2013 | Yu | E05D 7/043 | 16/238 |
| 8,578,556 | B1 * | 11/2013 | Yu | E05F 3/227 | 16/240 |

* cited by examiner

SYSTEM FOR THE ROTATABLE COUPLING OF A CLOSING ELEMENT AND STATIONARY SUPPORT STRUCTURE

FIELD OF THE INVENTION

The present invention is generally applicable to the technical field of the movement systems of a closing element such as a door, shutter or the like, and it particularly relates to a system for the rotatable coupling of a closing element and a stationary support structure, such as a wall, floor, frame or the like.

The system according to the present invention may be particularly useful for rotatable coupling a glass door or shutter to a floor or a frame.

BACKGROUND OF THE INVENTION

Systems for the rotatable coupling of a door and a frame, which generally include a hinge device (patch fitting) anchored to the door and a mounting element anchored to the frame are known.

In the European Patent EP2617925 is described an example of such rotatable coupling systems. In particular, the rotatable coupling system described in this document comprises a plurality of pieces and fixing screws.

Thus such known system is expensive and difficult to install and/or operate.

SUMMARY OF THE INVENTION

The object of the present invention is to at least partially overcome the above mentioned drawbacks by providing a rotating coupling system for a closing element and a stationary support structure having features of high functionality and low cost.

Another object of the invention is to provide a system that has a minimum number of constituent parts.

Another object of the invention is to provide an extremely low-bulkiness system.

Another object of the invention is to provide an extremely easy to install and/or to mount system.

Another object of the invention is to provide an extremely easy to use system.

Another object of the invention is to provide a system that has a very long duration.

Such purposes, as well as others which will appear more clearly hereinafter, are fulfilled by a system according to what is herein described, claimed and/or shown.

Advantageous embodiments of the invention are defined in accordance with the dependent claims.

BRIEF DESCRIPTION OF THE DRAWINGS

Further features and advantages of the invention will become more evident by reading the detailed description of some preferred but not exclusive embodiments, shown by way of non-limiting example with the help of the annexed drawing, wherein.

DETAILED DESCRIPTION OF A PREFERRED EMBODIMENT

Figure 1:
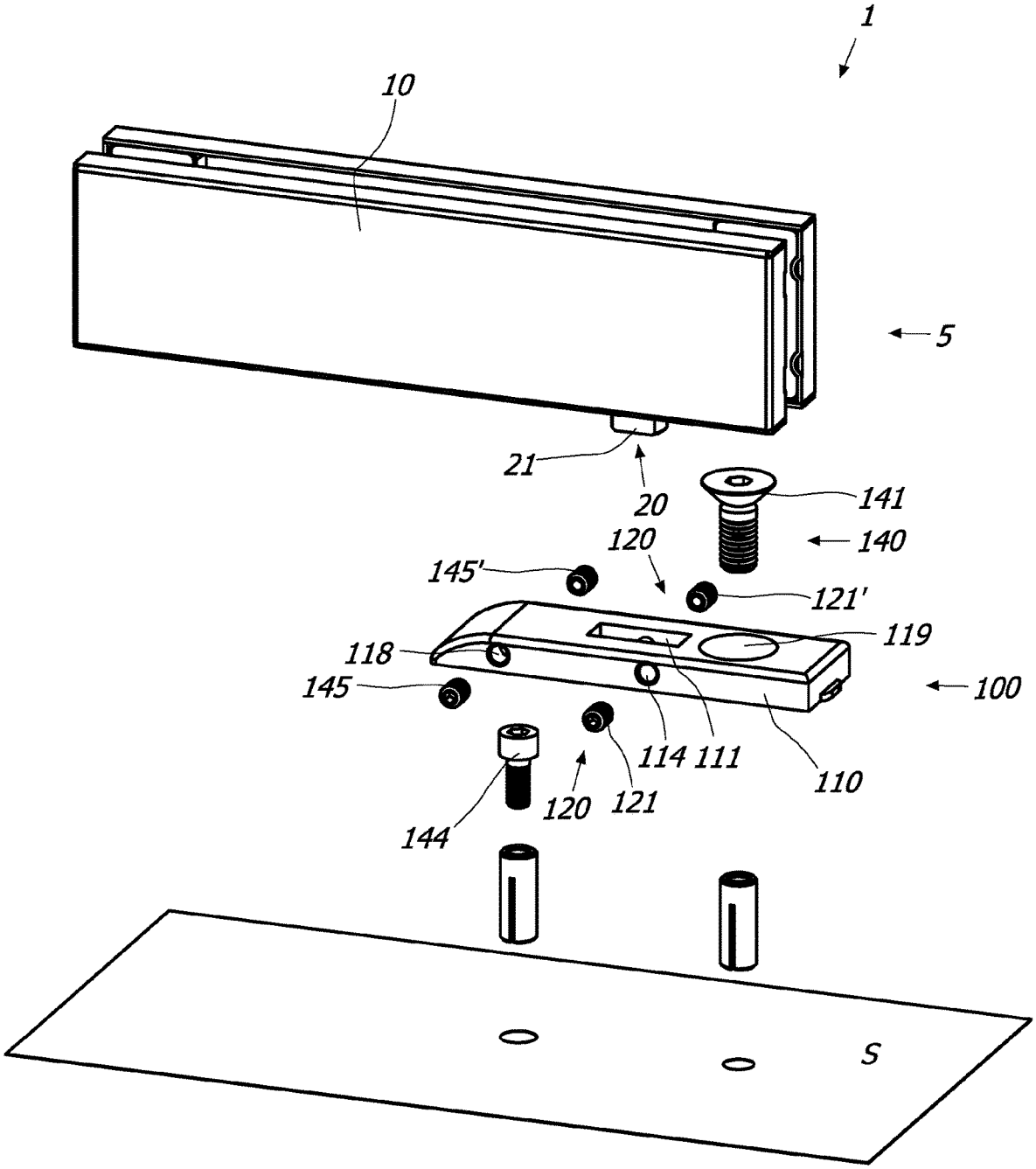
FIG. 1 is an exploded view of the system 1.

With reference to the figures, a system 1 for the rotatable coupling of at least one closing element D, such as a door, a shutter, a gate, a window or the like and a stationary support structure S for example such as a wall and/or frame of a door or window and/or a support pillar and/or the floor is described.

In particular, the closing element D may rotate between at least one closing position and at least one opening position.

Thus the system 1 may comprise a hinge device 5 anchorable to one of the stationary support structure S and the closing element D and an mounting plate 100 anchorable to the other of the stationary support structure S and the closing element D.

Preferably, as shown in the annexed figures, the hinge device 5 may be anchored to the closing element D, for example the door, while the mounting plate 100 may be anchored to the support structure S, for example to the floor or ceiling.

The hinge device 5 may be of any type. For example, it may be an opening and/or closing hinge of the closing element D, or a control hinge, or a simple movement hinge. In particular, in case the closing element D is a glass door or shutter, the hinge device 5 may be a patch fitting.

The hinge device 5 may particularly comprise a hinge body 10 and at least one pivot 20 which may define an axis X.

The hinge body 10 and the pivot 20 may be reciprocally coupled to reciprocally rotate around said axis X between at least one open position corresponding to the open position of the closing element D and at least one closed position corresponding to the closed position of the closing element D.

The hinge device 5 and the mounting plate 100 may be reciprocally coupled.

Suitably, the pivot 20 may include at least one coupling portion 21 protruding from the hinge body 10, while the mounting plate 100 may comprise at least one seat 111 for such coupling portion 21 of the pivot 20.

In particular, as shown in FIG. 1, the mounting plate 100 may comprise a plate-shaped body 110 which may include the seat 111. Preferably, the mounting plate 100 may consist only of the plate-shaped body 110.

In this case, the mounting plate 100 may be extremely low-cost and easy to mount.

On the other hand, the mounting plate 100 may consisting of several constituent parts assembled each other to form a unitary plate-shaped body 110.

According to a particular aspect of the invention, the plate-shaped body 110 may have an elongated shape so as to define an axis Y substantially perpendicular to the axis X. In particular, the hinge body 10 may have a predetermined width L1, while the plate-shaped body 110 may have a width L2 substantially equal to or less than the width L1 of the hinge body 10.

For example, the width L1 of the hinge body 10 may be 20 mm to 30 mm, preferably may be about 25 mm, equal to the width L2.

In this way, the system 1 may be particularly low-bulkiness and may give to the same system 1 a high aesthetic appeal.

According to a particular aspect of the invention, the seat 111 may have an elongated shape so as to define an axis Y' substantially perpendicular to the axis X. Possibly, the axis Y' may be substantially parallel to the axis Y of the hinge body 110. Preferably, the axes Y and Y' may coincide each other, as in the annexed claims.

The coupling portion 21 of the pivot 20 and the seat 111 may be reciprocally configured so that the former may be mobile within the latter along the axis Y'.

Figure 7:
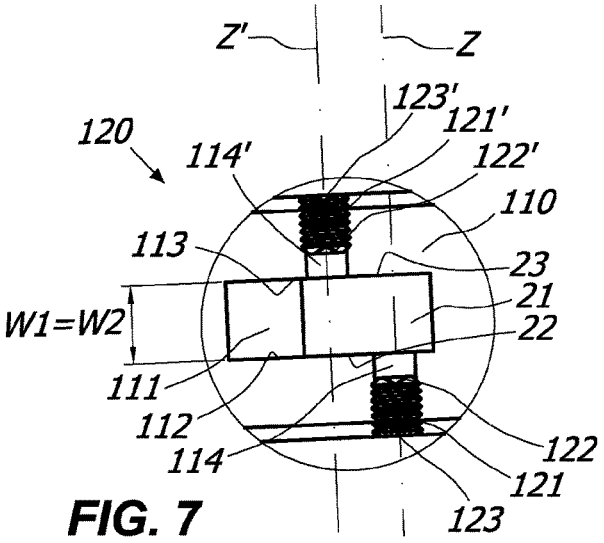

In particular, as schematically shown in FIG. 7, the seat 111 may have a pair of guide walls 112, 113 for guiding the sliding of the portion 21 of the pivot 20 along the axis Y'. More in detail, each of the guide walls 112, 113 may be reciprocally faced to a corresponding side wall 22, 23 of the coupling portion 21.

According to a particular aspect of the invention, the seat 111 and the coupling portion 21 may be reciprocally dimensioned so as to allow only the reciprocal sliding along the axis Y' and therefore the slider of the hinge device 5 along the same axis Y'.

In other words, once the seat 111 and the pivot 20 are coupled, the guide walls 112, 113 of the former and the side walls 22, 23 of the latter may be reciprocally in contact so as to prevent the reciprocal movement both in a direction transverse to the direction defined by the axis Y' and in a rotary direction.

In particular, the coupling portion 21 may have a predetermined thickness W2, and the seat 111 may have a width W1 substantially equal to the thickness W2 of the coupling portion 21.

For example, the width W1 of the seat 111 and the thickness W2 of the coupling portion 21 may be 6 mm to 12 mm and preferably may be about 9 mm.

In particular, the width W1 of the seat 111 may be significantly lower than the width L2 of the plate-shaped body 110. For example, the ratio between the width W1 of the seat 111 and the width L2 of the plate-shaped body 110 may be less than 0.5, preferably less than 0.4.

Figure 4:
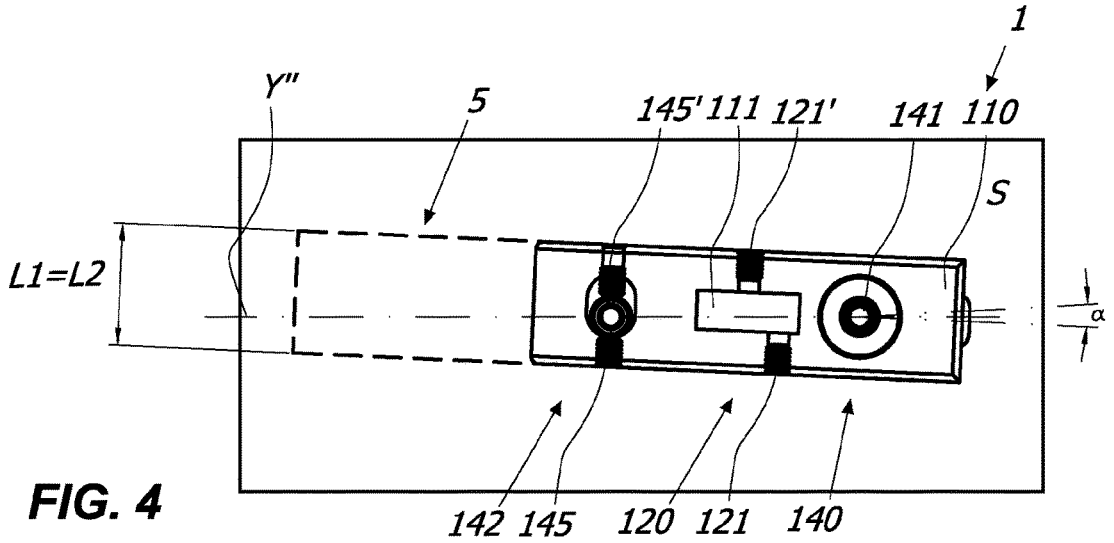
FIGS. 4 and 5 are schematic views of the system 1 in further operating phases.
Figure 5:
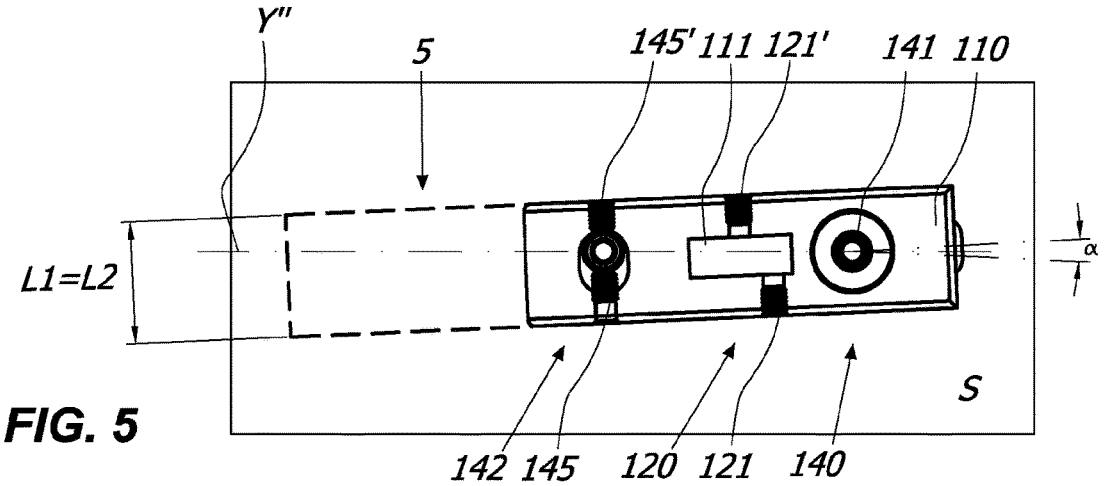

As shown in FIGS. 4 and 5, the seat 111 may further comprise at least one pair of bottom walls 115, 116 which may define the end position for the coupling portion 21 of the pivot 20. In other words, the pivot 20 may slide along the axis Y' between a first end stroke position in which abuts the bottom wall 115 and a second end stroke position in which abuts the opposite bottom wall 116.

According to another aspect of the invention, the plate-shaped body 110 may comprise means 120 to fasten the sliding of the portion 21 within the seat 111 passing through the guide walls 112, 113.

In particular, said fastening means 120 may comprise at least one adjusting screw 121 having a working end 122 susceptible to engage a corresponding side wall 22, 23 of the coupling portion 21 of the pivot 20 and a operateable end 123 accessible from outside by an operator.

Preferably, as particularly shown in FIG. 7, the fastening means 120 may comprise a plurality of adjusting screws 121, 121', for example a pair of them, placed on opposite sides with respect to the seat 111. More specifically, each adjusting screw 121, 121' may have a respective working end 122, 122' facing a respective side wall 22, 23 and a respective operating end 123, 123' accessible from outside by the operator.

The adjusting screws 121, 121' may act along a respective axis Z, Z' substantially transverse to the axis Y' and preferably perpendicular to the axis Y'.

Suitably, the plate-shaped body 110 may comprise passing through holes 114, 114' passing therethrough for the adjusting screws 121, 121' which may in turn have an axis corresponding to respectively the axis Z and the axis Z' to guide the latter.

In particular, when at least one of the ends 122, 122' of the adjusting screws 121, 121' abut the respective side wall 22, 23 of the coupling portion 21 of the pivot 20, the latter may be fastened inside the seat 111 in any position between the first and second end stroke position.

Thanks to these features, an accurate adjustment of the sliding along the axis Y' and more generally along the hinge device 5 may be possible.

The plate-shaped body 110 may be solidly coupled with the stationary support structure S and may include means 140 for adjusting its position with respect to the same stationary support structure S.

The adjustment means 140 may comprise an element for the rotatable fastening of the plate-shaped body 110 to the stationary support structure S, for example a pivot or a screw 141 interacting with a corresponding circular slot 119. In particular, such screw 141 may define a rotation axis X' for the plate-shaped body 110, which may be essentially parallel to the axis X.

Figure 2:
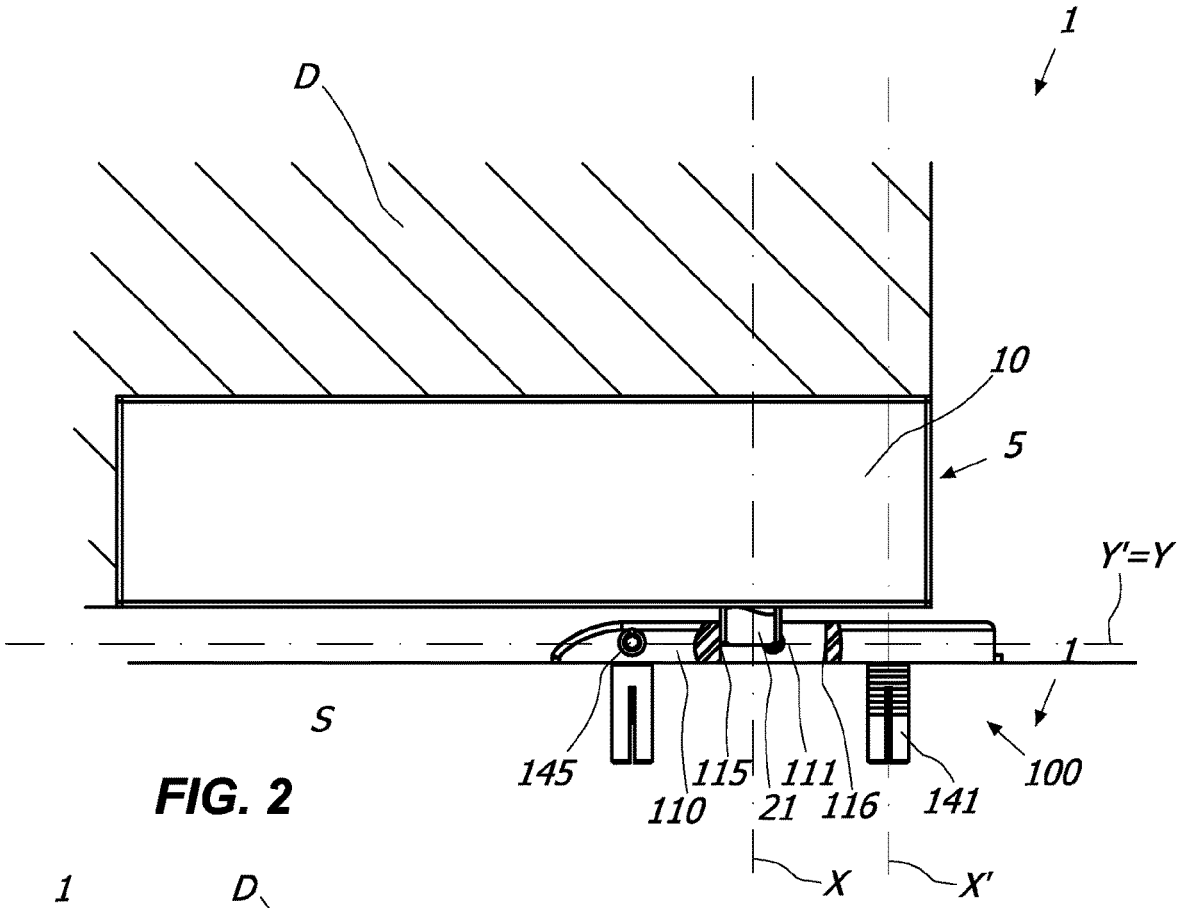
FIGS. 2 and 3 are side views of the system 1 at different operating phases.
Figure 3:
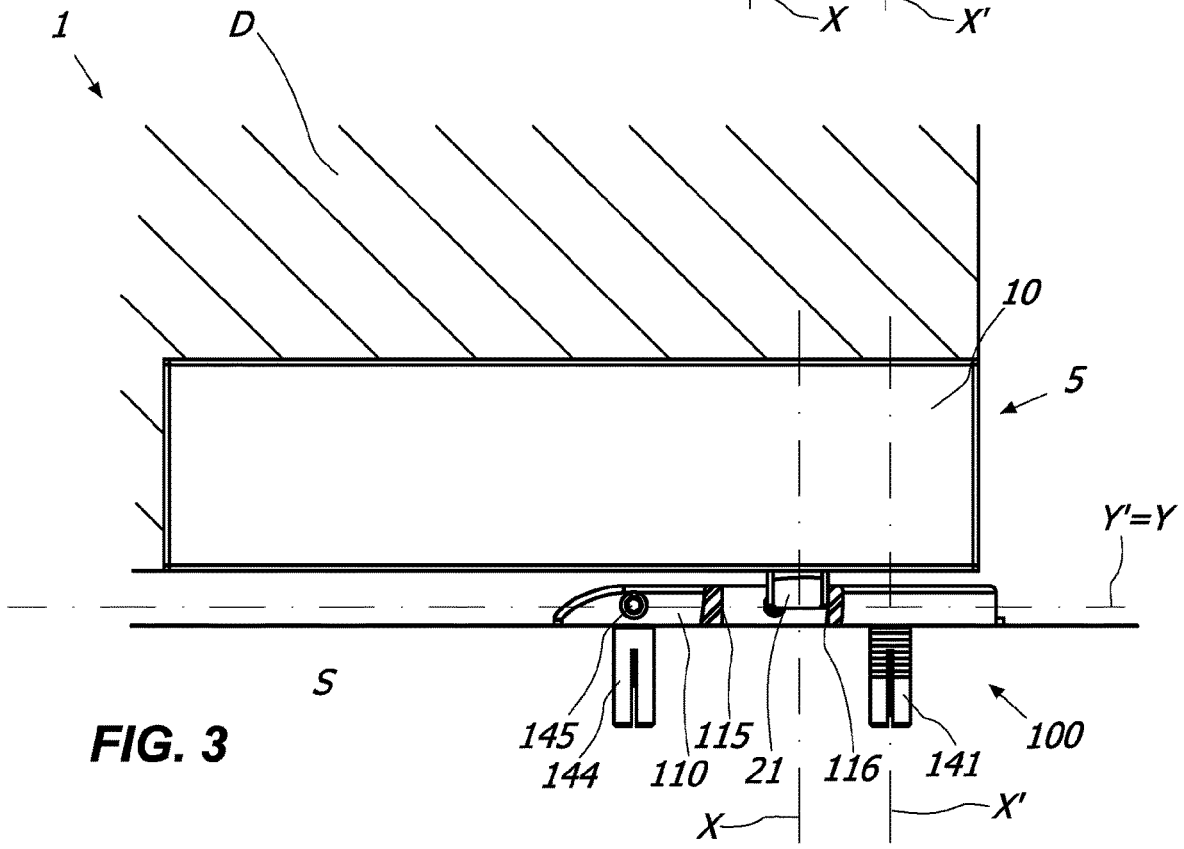

Thanks to the features above mentioned, the pivot 20 (thus the hinge device 5) may slide along the axis Y' (FIGS. 2 and 3) and may rotate around the axis X' (FIGS. 4 and 5).

According to a further aspect of the invention, the adjustment means 140 may include means 142 for limiting the rotation of the plate-shaped body 110 around the axis X'.

Such a feature may be particularly advantageous if the system 1 is mounted on a frameless glass door.

For example, the limiting means 142 may include an elongate slot 143 on the plate-like body 110 to remain facing the stationary support structure S. In particular, an elongated slot 143 may be defined by a recess in the plate-shaped body 110.

Suitably, the limiting means 142 may comprise an abutment element 144, such as a pivot, fixed to the stationary support structure S and interacting with the elongated slot 143. To this end, the abutment pivot 144 may have the expanded upper part into the elongated slot 143.

In particular, the latter and the abutment element 144 may be reciprocally coupled so that upon the rotation of the plate-shaped body 110 around the axis X' the elongate slot 143 moves with respect to the abutment element 144 between at least one first end stroke position (FIG. 4) and at least one second end stroke position (FIG. 5).

More specifically, as shown in FIGS. 4 and 5, the plate-shaped body 110 and thus the axis Y may rotate of a predetermined angle $\alpha$ around the axis X' with respect to the axis Y" passing through the abutment element 144 and the screw 141.

Figure 6:
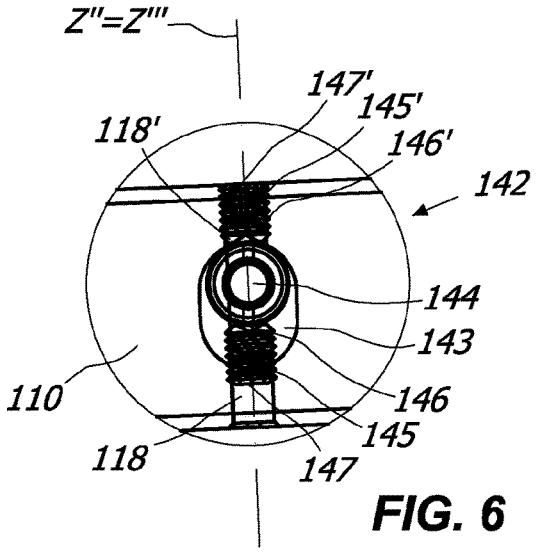
FIGS. 6 and 7 are enlarged schematic views of some details of system 1.

According to a further aspect of the invention, as particularly shown in FIG. 6, the limiting means 142 may include at least one adjusting screw 145, preferably a pair of adjusting screws 145, 145' passing through the plate-shaped body 110 and acting within the row 143 to vary the position of one and/or both the end stroke positions.

As stated above for adjusting screws 121, 121', the adjusting screws 145, 145' may have a respective working end 146, 146' facing the slot 143 and a respective operating end 147, 147' accessible from outside by the operator so that the latter may vary one and/or both the end stroke positions.

In particular, the adjusting screws 145, 145' may act along a respective axis Z", Z'" substantially transversely to the axis Y' and preferably perpendicular to the axis Y'. Possibly, such axis Z", Z'" may be substantially coincident.

Suitably, the plate-shaped body 110, similar to the through holes 114, 114', may comprise passing through holes 118,

118' for the adjusting screws 145, 145' which may thus have an axis which coincides with, respectively, the axis Z" and the axis Z'".

From the above description, it appears evident that the hinge according to the invention fulfils the intended objects.

The invention is susceptible of numerous modifications and variations, all falling within the annexed claims. All the details may be replaced with other technically equivalent elements, and the materials may be different according to requirements, without departing from the scope of the invention defined by the annexed claims.

The invention claimed is:

1. A system for rotatable coupling of a closing element and a stationary support structure, comprising:

a hinge device adapted to be anchored to the closing element; and a mounting plate adapted to be anchored to the stationary support structure, wherein the hinge device comprises a hinge body and a pivot defining a first axis, the hinge body and the pivot being reciprocally coupled to rotate around the first axis, the pivot including a coupling portion protruding from the hinge body, wherein the mounting plate includes a plate-shaped body having a seat adapted to receive the coupling portion of the pivot, the plate-shaped body including an adjustment member adapted to adjust a position the plate-shaped body with respect the stationary support structure, wherein the adjustment member includes a rotatable mounting element that enables of a rotatable mounting of the plate-shaped body to the stationary support structure, the rotatable mounting element defining a third rotation axis for the plate-shaped body essentially parallel to the first axis, the adjustment member further including a limiting system that limits a rotation of the plate-shaped body around the third axis by a predetermined angle, and wherein the limiting system includes an elongated slot on the plate-shaped body facing the stationary support structure, and an abutment element fixed on the stationary support structure, the elongated slot and the abutment element being reciprocally coupled so that the elongated slot moves with respect the abutment element between at least two end stroke positions, the limiting system further including at least one adjustment screw passing through the plate-shaped body and acting within the elongated slot to vary a position of one of the end stroke positions.

2. The system according to claim 1, wherein the coupling portion of the pivot has a predetermined thickness, the seat on the plate-shaped body having a width that is essentially equal to the predetermined thickness.

3. The system according to claim 2, wherein the seat has an elongated shape to define a second axis that is essentially perpendicular to the first axis, the coupling portion of the pivot and the seat being reciprocally sized so as to exclusively allow a sliding of the hinge device along the second axis, thus preventing one or both of a rotatable or a transverse movement with respect thereto.

4. The system according to claim 3, wherein the coupling portion of the pivot is slidably movable in the seat to allow the sliding of the hinge device along the second axis.

5. The system according to claim 4, wherein the seat has a pair of guide walls configured to guide the sliding of the coupling portion of the pivot, the plate-shaped body further including one or more fastening members to fasten the sliding of the plate-shaped body, the one or more fastening members passing through the guide walls.

6. The system according to claim 5, wherein each of the guide walls faces a corresponding side wall of the coupling portion of the pivot, the one or more fastening members including at least one adjusting screw having a working end adapted to engage a corresponding side wall of the coupling portion of the pivot and an operable end accessible from outside by an operator.

7. The system according to claim 1, wherein the plate-shaped body has an elongated shape to define a fourth axis essentially perpendicular to the first axis, the hinge body having a predetermined width, the plate-shaped body having a width that is less than or equal to the predetermined width of the hinge body.

8. The system according to claim 7, wherein a ratio between a width of the seat of the plate-shaped body and the width of the plate-shaped body is less than 0.5.

* * * * *